US011759687B2

(12) United States Patent
Lambeth et al.

(10) Patent No.: US 11,759,687 B2
(45) Date of Patent: Sep. 19, 2023

(54) PERFORMANCE-BASED GOLF CLUB SELECTION SYSTEM AND METHOD

(71) Applicant: SUMITOMO RUBBER INDUSTRIES. LTD., Kobe (JP)

(72) Inventors: Jacob Lambeth, Irvine, CA (US); Jeff D. Brunski, Los Angeles, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 149 days.

(21) Appl. No.: 17/499,358

(22) Filed: Oct. 12, 2021

(65) Prior Publication Data

US 2022/0023735 A1 Jan. 27, 2022

Related U.S. Application Data

(62) Division of application No. 15/941,786, filed on Mar. 30, 2018, now abandoned.

(60) Provisional application No. 62/492,018, filed on Apr. 28, 2017.

(51) Int. Cl.

| | |
|---|---|
| ***A63B 60/46*** | (2015.01) |
| ***A63B 60/42*** | (2015.01) |
| ***A63B 53/04*** | (2015.01) |
| ***A63B 69/36*** | (2006.01) |
| *A63B 102/32* | (2015.01) |

(52) U.S. Cl.

CPC ..... *A63B 60/46* (2015.10); *A63B 53/0466* (2013.01); *A63B 60/42* (2015.10); *A63B 69/3617* (2013.01); *A63B 53/04* (2013.01); *A63B 53/045* (2020.08); *A63B 69/3605* (2020.08); *A63B 2102/32* (2015.10); *A63B 2220/803* (2013.01); *A63B 2220/833* (2013.01)

(58) Field of Classification Search

CPC ..... A63B 60/42; A63B 60/46; A63B 69/3605

See application file for complete search history.

(56) References Cited

U.S. PATENT DOCUMENTS

| | | | | |
|---|---|---|---|---|
| 5,836,830 | A * | 11/1998 | Onuki | A63B 53/04 473/324 |
| 6,192,323 | B1 * | 2/2001 | Boehm | A63B 69/3605 702/182 |
| 6,328,660 | B1 * | 12/2001 | Bunn, III | G01H 13/00 473/409 |
| 6,368,234 | B1 * | 4/2002 | Galloway | A63B 60/00 473/324 |
| 6,398,666 | B1 * | 6/2002 | Evans | A63B 53/04 473/345 |

(Continued)

*Primary Examiner* — Laura Davison

(74) *Attorney, Agent, or Firm* — Oliff PLC

(57) ABSTRACT

A method of selecting a golf club head for a specific user, includes: (a) receiving first data comprising impact location of each of a plurality of golf swings taken by the user using a test golf club; (b) generating an impact probability map specific to the user; (c) providing second data comprising correlations between striking face location and coefficient of restitution (COR) for each of a plurality of golf clubs; (d) calculating a user-specific expected COR value for each of the plurality of golf clubs based on the first data, the impact probability map, and the second data for each of the plurality of golf clubs; and (e) outputting and displaying golf club preference information based on the calculated user-specific expected COR.

16 Claims, 5 Drawing Sheets

(56) References Cited

U.S. PATENT DOCUMENTS

| | | | | |
|---|---|---|---|---|
| 6,966,843 | B2 * | 11/2005 | Rankin | A63B 24/0021 473/202 |
| 7,029,403 | B2 * | 4/2006 | Rice | A63B 60/00 473/345 |
| 7,156,759 | B2 * | 1/2007 | Pollman | A63B 53/0487 473/409 |
| 7,618,331 | B2 * | 11/2009 | Hirano | A63B 60/00 473/346 |
| 7,704,162 | B2 * | 4/2010 | Rice | A63B 53/0466 473/345 |
| 7,935,003 | B2 * | 5/2011 | Matsunaga | A63B 53/0466 473/345 |
| 8,083,612 | B2 * | 12/2011 | Stites | A63B 53/047 473/345 |
| 8,229,710 | B2 * | 7/2012 | Matsunaga | A63B 53/04 703/2 |
| 8,229,711 | B2 * | 7/2012 | Matsunaga | A63B 60/42 703/2 |
| 8,251,834 | B2 * | 8/2012 | Curtis | A63B 53/0466 473/330 |
| 8,414,419 | B2 * | 4/2013 | Curtis | A63B 60/00 473/345 |
| 8,641,548 | B2 * | 2/2014 | Rauchholz | A63B 60/22 473/238 |
| 9,162,115 | B1 * | 10/2015 | Beach | A63B 53/04 |
| 2004/0162157 | A1 * | 8/2004 | Naito | A63B 53/04 473/324 |
| 2013/0029780 | A1 * | 1/2013 | Beno | A63B 53/0466 473/324 |

* cited by examiner

Z-745

TOP-BOTTOM POSITION

| | | | | | | | | | | | |
|---|---|---|---|---|---|---|---|---|---|---|---|
| | | Z745 | | | | | | | | | 15 mm |
| | | 0.769 | 0.797 | 0.795 | 0.793 | 0.808 | 0.789 | 0.777 | | | 10 mm |
| | 0.78 | 0.782 | 0.801 | 0.809 | 0.815 | 0.815 | 0.809 | 0.786 | 0.787 | | 5 mm |
| | 0.761 | 0.781 | 0.802 | 0.81 | 0.807 | 0.814 | 0.81 | 0.792 | 0.768 | | 0 |
| | 0.73 | 0.762 | 0.781 | 0.787 | 0.793 | 0.793 | 0.787 | 0.773 | 0.751 | | 5 mm |
| | | 0.737 | 0.749 | 0.75 | 0.767 | 0.753 | 0.754 | 0.73 | | | 10 mm |
| | | | | | | | | | | | 15 mm |
| | 20 | 15 | 10 | 5 | 0 | 5 | 10 | 15 | 20 | | |

TOE-HEEL POSITION

FIG. 5

PERFORMANCE-BASED GOLF CLUB SELECTION SYSTEM AND METHOD

RELATED U.S. APPLICATION DATA

This application is a divisional of U.S. application Ser. No. 15/941,786, filed on Mar. 30, 2018, which claims priority to U.S. Provisional Patent Application No. 62/492,018, filed Apr. 28, 2017, the entire disclosures of which are incorporated herein by reference.

BACKGROUND

Success in the game of golf is a function of a player's accuracy, judgment, and strength. To ensure fairness, the United States Golf Association (USGA) (as well as similar organizations) serves as a regulatory body governing the play, and equipment used in the play, of professional golf.

The USGA specifically sets forth rules limiting the ability of a golf club to transfer power to a golf ball, thereby limiting any advantage a golfer may seek over a competitor by equipment alone. This is generally accomplished by use of characteristic time (CT) measurement of the face of the club head. Characteristic time, for all purposes herein, refers to characteristic time as laid out, defined, and indicated as measured in the United States Golf Association's PROCEDURE FOR MEASURING THE FLEXIBILITY OF A GOLF CLUBHEAD, Rev. 1.0.0 (May 1, 2008).

However, golfers, particularly those with higher handicaps, tend not to impact golf balls, in the course of play, in a single location nor in the precise location desired by the golfer. Instead, throughout the course of play, ball impacts may occur at various locations of the striking face. In consideration of this, CT value, alone, may not be an accurate representation of the overall performance of the club head, particularly as handicap increases. Thus, a need exists for an accurate method of measuring the performance potential of a golf club head.

SUMMARY

In accordance with one or more aspects, a method of manufacturing a golf club head includes a number of steps, including (a) providing a model of a golf club head, the model including a striking face portion and a first plurality of structural attributes; (b) generating first data comprising relationship information between locations about the striking face location and predicted coefficient of restitution or characteristic time values based on modeled golf ball impact; (c) providing second data comprising relationship information between generalized striking face position and impact probability; (d) calculating a first expected overall performance value based on the first data and the second data; (e) modifying the first plurality of structural attributes based on the first expected overall performance value, resulting in a second plurality of structural attributes different from the first plurality of structural attributes; and (f) forming a golf club head having club head structural attributes corresponding to the second plurality of structural attributes of the model.

In accordance with another aspect, a method of golf club selection includes the steps of: (a) providing first data comprising, for each of a plurality of distinct golf club heads, relationship information between coefficient of restitution or characteristic time values and striking face location; (b) receiving second data comprising impact location information based on plural impacts about a striking face of a test golf club generated by a particular user; (c) calculating, based on the second data, third data comprising relationship information between impact probability and striking face location for the particular user; (d) based on the first data and the third data, calculating, for each of the plurality of distinct golf club heads, an expected overall performance value specific to the particular user; and (e) causing to be output recommendation information based on the calculated expected overall performance values.

BRIEF DESCRIPTION OF THE DRAWINGS

The drawings described below are for illustrative purposes only and are not intended to limit the scope of the present invention in any way. Exemplary implementations will now be described with reference to the accompanying drawings, wherein:

Referring to FIG. 5, a table is shown in accordance with one or more aspects of the disclosure;

While various features will be described in conjunction with the examples outlined below, various alternatives, modifications, variations, and/or improvements of those features and/or examples may be possible. Accordingly, the examples, as set forth below, are intended to be only illustrative. Various changes may be made without departing from the broad spirit and scope of the underlying principles.

DESCRIPTION

Figure 2:
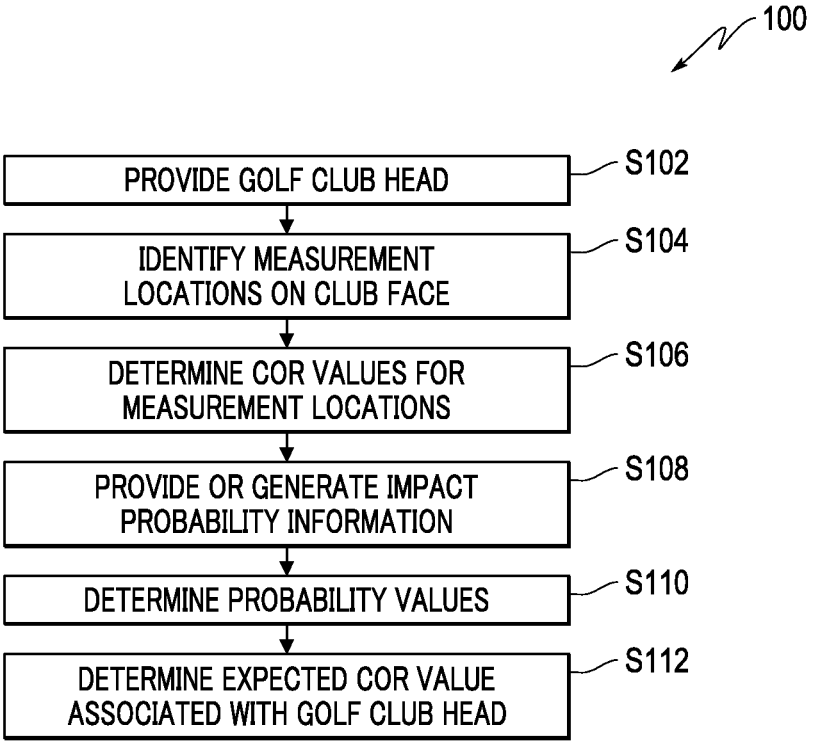
Referring to FIG. 2, a flowchart is shown in accordance with one or more aspects of the disclosure.

In accordance with one or more aspects, referring to FIG. 2, a process 100 is carried out for accurately assessing the performance of a golf club head. The chronological order of the steps discussed below is by way of example, and not intended to limit the scope of the disclosure. Unless otherwise indicated, the below processes are not limited to the following steps or to the chronological nature of the steps as they are presented. Unless otherwise stated, the relative chronology of steps need not follow the particular order in which they are described below.

In a first step 102, a golf club head is provided. Preferably, the golf club head is a wood-type club head, more preferably a hollow metal wood head, most preferably a driver-type club head. The club head 10 (see e.g. FIG. 1) includes a striking wall having a striking face 32 configured to impact a golf ball, a top wall 34 extending rearward from the striking face 32, and a bottom wall 36 extending rearward from the striking face 32 opposite the top wall 34.

Next, in step 104, plural measurement locations are identified and superimposed on the striking face 32 of the golf club head 10. Preferably, the locations represent regions having boundaries laid out at constant intervals along both the heel-to-toe direction and the top-to-bottom direction, with a virtual origin, e.g., corresponding to the face center 33 of the club head 10.

The face center 33, as used herein, is located using a standard template. The template has a coordinate system with a heel-toe axis orthogonal to a top-bottom axis. An aperture is disposed at the origin of the coordinate system, with the axes being graduated into evenly spaced increments. The template may be made of a flexible material, e.g., a transparent polymer. The location of the face center 33 is determined by initially applying the template to the striking face 32 so that the aperture is approximately in the middle of the striking face 32 and the heel-toe axis is generally horizontal. The template is then translated in the heel-toe direction along the striking face 32 until the heel and toe measurements along the axis at opposite points on the striking face perimeter of the striking face 32 proximate respective ones of the heel and toe portions 38 and 40 have the same absolute value. Once the template is centered with respect to the striking face 32 in the heel-toe direction, the template is translated into the top-bottom direction along the striking face 32 until the measurements along the axis at opposite points on the striking face perimeter of the striking face 32 proximate respective ones of the top and bottom portions 34 and 36 have the same absolute value. The above sequence is repeated until the absolute value of the heel measurement along the axis is equal to that of the toe measurement and the absolute value of the bottom measurement along axis is equal to that of the top measurement. A point is then marked on the striking face 32 through the aperture to designate the face center 33. A locating template is referenced in the United States Golf Association's Procedure for Measuring the Flexibility of a Golf Clubhead (Revision 2.0, Mar. 25, 2005) and is available from the USGA.

In other embodiments, the reference point may be the intersection of the hosel axis 42 of a hosel 41 and the ground plane 44 as projected with the club head in front elevation and oriented in reference position relative to the ground plane 44.

Figure 1:
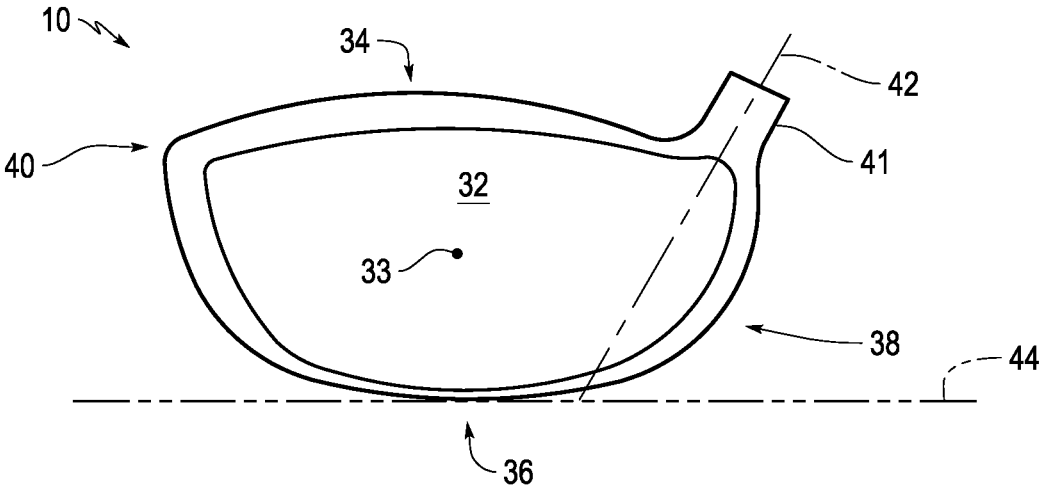
Referring to FIG. 1, a golf club head is shown in accordance with one or more aspects of the disclosure.

The golf club head 10 is depicted in FIG. 1 as being in a "reference position." As used herein, "reference position" denotes a position of a club head wherein the bottom portion of the club head rests on an imaginary ground plane such that the hosel centerline lies in an imaginary vertical hosel plane that contains an imaginary horizontal line generally parallel to the striking face. Unless otherwise indicated, all parameters herein are specified with the golf club head 10 in the reference position.

Figure 3:
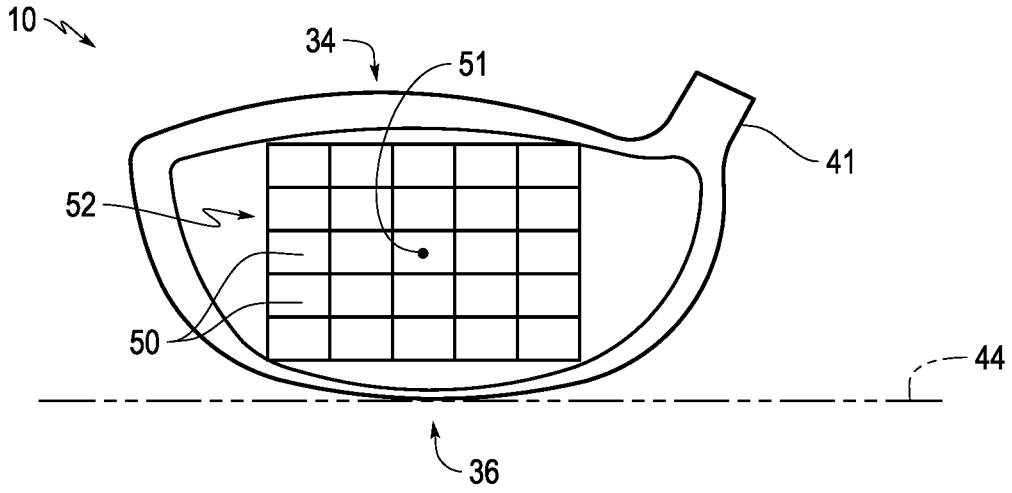
Referring to FIG. 3, a schematic is shown superimposed on a striking face of a golf club head in accordance with one or more aspects of the disclosure.
Figure 4:
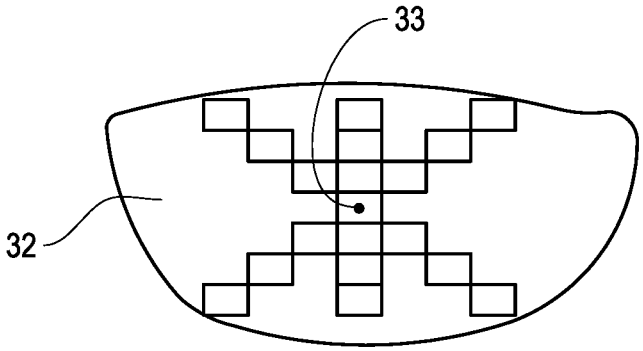
Referring to FIG. 4, a schematic is shown superimposed on a striking face of a golf club head in accordance with one or more aspects of the disclosure.

In some embodiments, the plurality of measurement locations corresponds to square or rectangular area regions, or "bins," 50 having a height and width of e.g. 5 mm. A central origin-located bin 51 defines a center that coincides with the face center 33 of the club head 10. Other bins are adjacently aligned horizontally and vertically to form a bin matrix 52 e.g. as shown in FIG. 3, where geometric centers of the plurality of bins are spaced at respective 5 mm intervals from the geometric center of the central bin 51, both vertically and horizontally. In other embodiments, measurement locations correspond to points rather than area regions. In yet other embodiments, measurement locations correspond to area regions that are spaced from each other and thus do not abut. In yet other embodiments, the orientations of "bins" do not form a matrix, but rather an irregular arrangement of bins or other geometry configuration, e.g. an annulus or sunburst (see e.g. FIG. 4). In some aspects, the area of the striking face 32 designated to such measurement bins includes an area+/−22.5 mm horizontal and +/−12.5 mm vertical from the face center 33.

Next, in step 106, coefficient of restitution (COR) values are determined and assigned to each of the plurality of bins. Preferably, COR values are determined using conventional cannon testing in conformance with the USGA's prescribed method for determining COR. Preferably, for each such bin, an impact (or testing set of plural impacts) is measured at the geometric center of the bin or, in some embodiments, at plural locations within the bin and averaged. A COR "map" is then optionally generated of the striking face results, e.g. the COR map as shown in FIG. 5.

Figure 6:
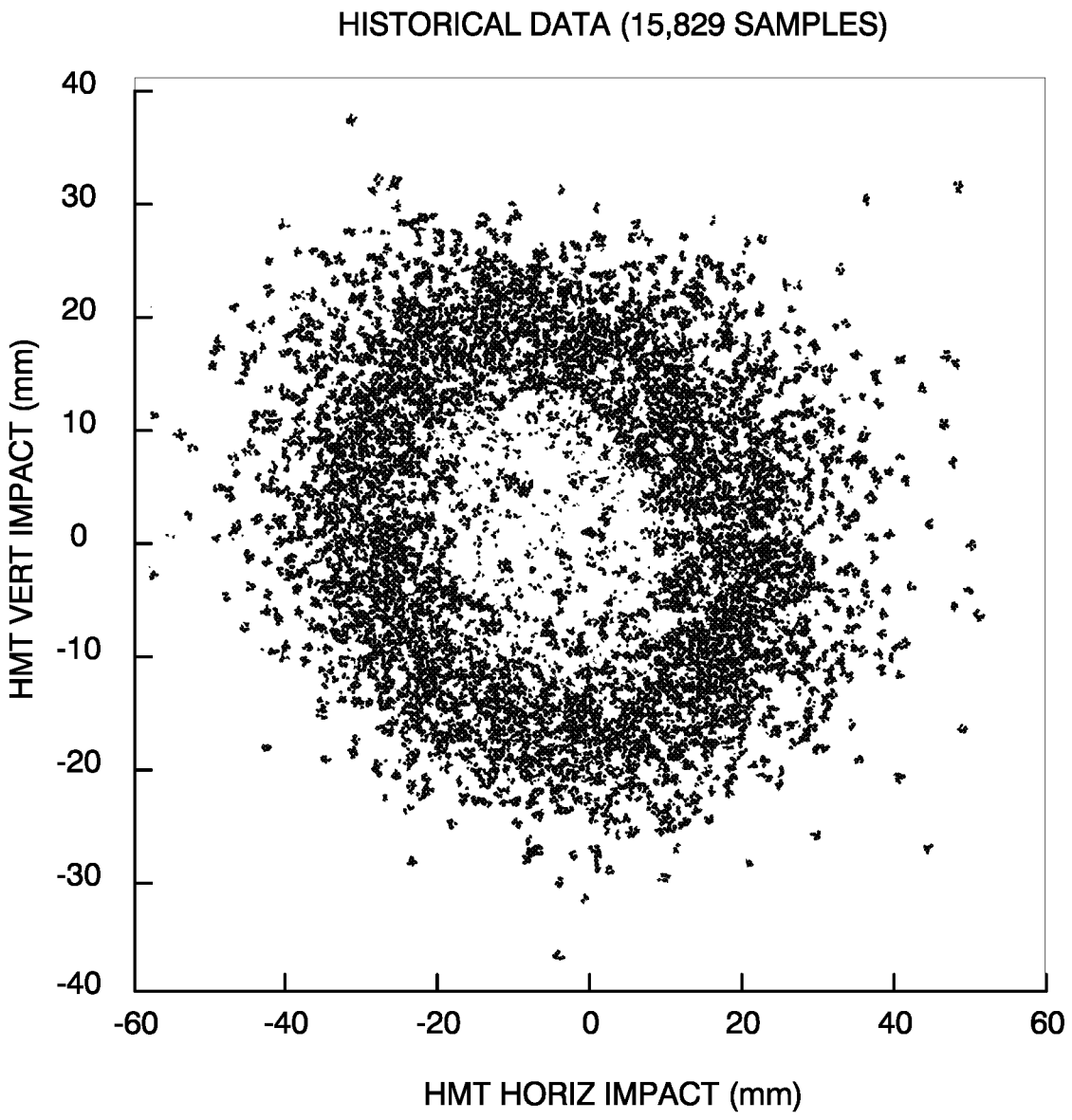
Referring to FIG. 6, a frequency plot is shown in accordance with one or more aspects of the disclosure.

Next, in step 108, impact probability information is either generated or obtained and correlated with each of the plurality of bins. In some aspects, cameras, a launch monitor, sensors, accelerometers, piezoelectric materials, position sensors, etc., are used to track and memorialize impact locations for a predetermined pool of users. Preferably, the pool of users constitutes a representative cross-section of the golfing public, e.g. selected such that the handicap profile of the pool is proportional to known or understood handicap profile curves of the golfing public. In other embodiments, a particular segment (e.g. "high handicappers" or "low handicappers") of the golfing public is selected and a pool of players is particularly selected to match such particular segment. In any such embodiment, impacts among players are optionally aggregated and plotted relative to the plurality of bins to generate an impact-frequency map (e.g. as shown in FIG. 6).

Next, in step 110, impact probability values are calculated for each of the plurality of bins. In some embodiments, primarily, the probability of impacts within all bins compared to total impacts (i.e. including impacts occurring outside all bins) is calculated. In some embodiments, the bin by bin probability may be expressed in terms of a probability matrix, P, e.g. as follows:

$$P = \begin{bmatrix} p_{11} & \cdots & p_{1m} \\ \vdots & \ddots & \vdots \\ p_{n1} & \cdots & p_{nm} \end{bmatrix}$$

where the probability of impact at location (i,j)=$p_{ij}$.

Similarly, in some embodiments, the bin by bin COR values determined in step 106 may be expressed in terms of a COR matrix, C, e.g. as follows:

$$C = \begin{bmatrix} c_{11} & \cdots & c_{1m} \\ \vdots & \ddots & \vdots \\ c_{n1} & \cdots & c_{nm} \end{bmatrix}$$

where the COR at location (i,j)=$c_{ij}$.

Next, in step 112, an "expected COR" value (or more broadly an "overall performance value") is generated based on the bin-by-bin (or location-by-location) impact probability information (generated in step 110) and the bin-by-bin (or location-by-location) COR information. The expected COR value may be considered to represent a probability-adjusted measure of club head performance that a typical golfer would actually expect given how impacts are actually dispersed about the face of a club head. Thus, using this information, a golfer may make a more informed decision in selecting a golf club based on its performance. Alternatively, or in addition, a golfer may better determine which clubs out of a plurality of golf clubs may be better suited to the golfer's specific needs, e.g. based on handicap or other measure of skill level.

In some embodiments, the probability-adjusted performance value is denoted "expected COR" and may be represented as the sum E[C] as defined below:

$$E[C] = \sum_{i=1}^{n} \sum_{j=1}^{m} p_{ij} * c_{ij}$$

Alternatively, or in addition, if the COR map and probability distribution (joint density) were considered as continuous functions, expected COR value could be represented as follows:

$$E[C] = \int_{-\infty}^{\infty} \int_{-\infty}^{\infty} p(x, y) * c(x, y) dx\ dy$$

where x and y are the horizontal and vertical impact locations, respectively.

The above process bears with it particular benefits. For example, using the above process, information could be provided to a user or users to better select an appropriate golf club head from among a plurality of different club heads, which may bear different "expected" COR values. Along the same lines, users may better identify, of a plurality of different golf clubs, which golf clubs are better suited for say low-, mid-, and high-handicap players, respectively. Additionally, or alternatively, a manufacturer may associate "expected COR" information as indicia on a particular golf club head to better communicate its latent properties to the user.

Notwithstanding the above direct benefits, additional functionality may be achievable based on the above processes and/or information determined therefrom. Such derived aspects will be described below.

Figure 7:
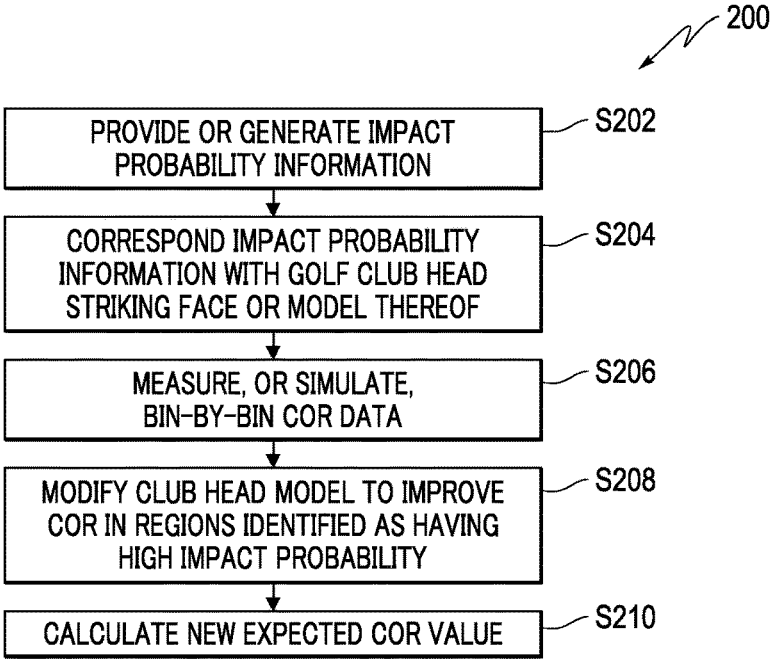
Referring to FIG. 7, a flowchart is shown in accordance with one or more aspects of the disclosure; and Referring to FIG. 8, a flowchart is shown in accordance with one or more aspects of the disclosure.

In some embodiments, expected COR data may be used to design and manufacture a golf club head having improved performance. For example, as shown in FIG. 7, a method 200 is shown for manufacturing (or improving upon) a golf club head, based on one or more process steps described above with regard to the embodiments shown in FIG. 2.

In step 202, impact probability information is generated or provided. Such information may correspond to the information generated or provided in step 102. In step 204, the impact probability information is associated with a prototype golf club head or golf club head as may be modeled electronically e.g. in conventionally available finite element analysis software.

Next, in step 206, COR information (e.g. like COR information determined in step 106 of the method shown in FIG. 2) is obtained. For a physical prototype golf club head, this information may be achieved using USGA COR testing protocol as described above. For electronic models, such testing may be simulated. Preferably, in some embodiments, probabilities and COR values are assigned on a bin-by-bin basis in like manner as described above with regard to the process of FIG. 2. Next, an expected COR value is generated based on the impact probability data and the COR data and outputted to a user, e.g. via electronic display and/or printer.

Finally, in step 208, the golf club prototype or golf club model is modified, based on the expected information generated in steps 202, 204 and 206. In some embodiments, this modification occurs by a user, whereby bins or other regions are identified as having relatively high impact probability and a relatively low COR value (or lower than possible while still providing for adequate structural integrity of the club head and maintaining the club head, in its totality, as conforming to the regulations of the USGA and/or other regulatory body). This process may also involve iteratively modifying the structure of the club head, primarily the club face, to both decrease the COR value of bins identified as having relatively low impact probability, and, in turn, raising COR value in bins identified as bearing the opposite, i.e. relatively high impact probability and relatively low COR value.

Such modifications to the club head may be carried out, e.g. by the selective placement/removal of discretionary mass and/or stiffening elements (e.g. ribs). It is a known aspect of golf club head design to consider the total mass of the club head (or the targeted total mass of the club head) as comprised of structural mass and discretionary mass. Structural mass generally refers to mass necessary to establish the minimal structural integrity necessary for the club head to be operable for its intended purpose. Discretionary mass, on the other hand, refers to the remaining mass that, given a target mass budget, is not necessary for establishing the structural integrity of the club head and, thus, may be positioned primarily to manipulate mass and performance properties of the club head. For example, it is known that the COR of various locations about the striking face may be varied by the selective thickening and thinning of regions of the striking face. Additionally, it is known to locate stiffening features such as ribs on portions of the striking face and optionally in connection with other portions of the club head, e.g. the sole portion and/or the top portion. Thus, the user, provided with the information generated in steps 202, 204, 206, 208, and provided known relationships between COR and striking face thickness, may be afforded the capability of reforming the striking face to generate a golf club head having an increased expected COR. Finally, in step 210, a new expected COR value is generated and outputted.

In some embodiments, steps 202 through 210 are carried out using a computer having a hardware processor, whereby program code is embodied on recordable medium. The code may be configured to cause the processor to, e.g., simulate COR value generation using finite element analysis, calculate expected COR values. In some embodiments, a program stored on recordable medium includes instructions for automatically prescribing point-by-point, region-by-region, or bin-by-bin, striking face thickness based on the information provided in steps 202 through 208 as well as predetermined relationships between variable striking face thickness and COR, and in a manner that is optimized for the particularly dimensioned and weighted golf club head provided.

In some embodiments, the process of FIG. 7 is carried out, but with the additional aspect that the provided or generated impact probability data corresponds to segmented user data, e.g. on the basis of handicap. In such case, different golf club heads may be generated that are selectively tailored to golfers of various skill strata.

Figure 8:
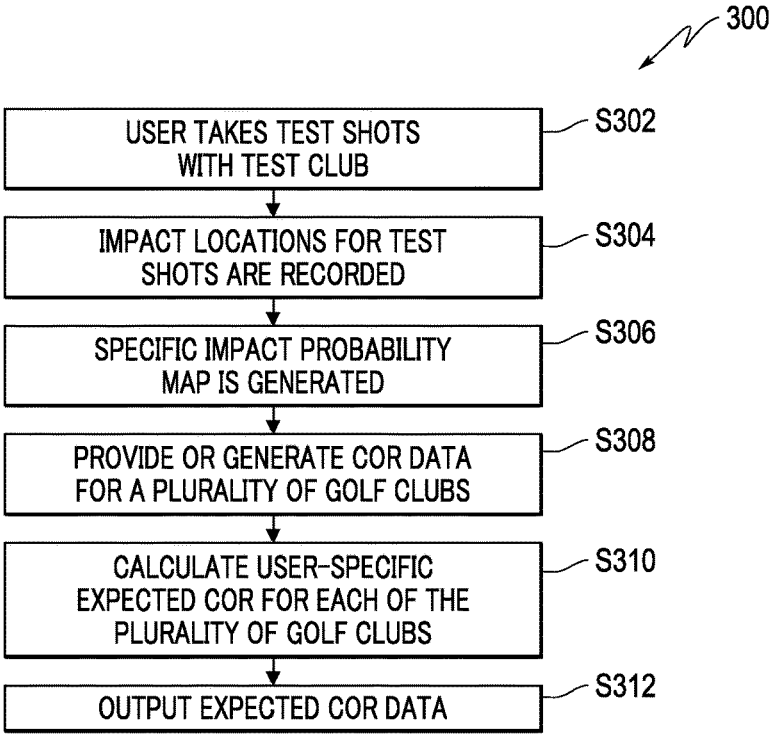

In some embodiments, a club selection process is carried out, e.g. at a retail or other public facility. Referring to FIG. 8, in step 302 of method 300, a golfer engages with a test golf club and hits a plurality of golf shots. In step 304, using impact location sensors via an attachable electronic swing tracking device, and/or launch monitor using motion sensing devices, impact locations are recorded for each shot.

In step 306, using a computer having a processor, program code stored on recordable medium is configured to instruct the processor to calculate user-specific impact probability information, preferably on a bin-by-bin basis as described above with regard to the method of FIG. 2. In some cases, bin-by-bin probability information is calculated based directly on the user impact points, e.g. the number of impacts per bin are counted and normalized to the total number of impacts. However, in other cases (particularly where the number of total sample impacts is relatively low, e.g. less than 100), the impact locations are compared against a best-fit standard probability function, such as a Gaussian distribution, or other predetermined algorithmic relationship modeling impact distribution.

Next, in step 308, COR information is provided, preferably in the form of bin-by-bin data for a plurality of golf clubs, which may be available to the user for purchase.

Next, in step 310, based on the COR information and the impact probability information, the software is configured to instruct the processor to calculate expected COR values (or "overall performance values") for each of the plurality of golf clubs that may be available to the user. Next, in step 312, the software instructs the processor to output the expected COR data to the user or other professional that may be assisting the user. The expected COR data may include the actual expected COR values for each golf club, information identifying which golf club resulted in the highest expected COR for such user, and/or a list of high-ranking expected COR golf clubs, optionally in order of highest to lowest. As a result, the golfer may be informed of which golf club is likely to perform best given the golfer's particular impact distribution "thumbprint."

As described above, the USGA recently migrated from COR to CT as a means for quantifying the "springiness" of a golf club head striking face. Accordingly, it is to be appreciated that any discussion above regarding COR, including measuring or using the COR at any particular location on the striking face of the club head, is to be understood as an implied disclosure of providing the same measurement with regard to CT. Furthermore, although COR and CT may not necessarily be analogous measurements, for all practical purposes herein, any disclosed COR value (or change in COR) or CT value (or change in CT value) should be considered an implicit disclosure of a corresponding CT or COR value (or change therein), respectively, in accordance with the following formula:

$$\text{CT value microsecon}=(\text{COR}-0.718)/0.000436$$

For example, any step of calculating COR on a bin-by-bin basis should be interpreted to include the alternative step of calculating CT on a bin-by-bin basis.

While various features have been described in conjunction with the examples outlined above, various alternatives, modifications, variations, and/or improvements of those features and/or examples may be possible. Accordingly, the examples, as set forth above, are intended to be only illustrative. Various changes may be made without departing from the broad spirit and scope of the underlying principles.

We claim:

1. A method of selecting a golf club head for a specific user, the method comprising the steps of:

(a) receiving first data comprising impact location of each of a plurality of golf swings taken by the user using a test golf club;

(b) generating an impact probability map specific to the user;

(c) providing second data comprising correlations between striking face location and coefficient of restitution (COR) for each of a plurality of golf clubs;

(d) calculating a user-specific expected COR value for each of the plurality of golf clubs based on the first data, the impact probability map, and the second data for each of the plurality of golf clubs; and (e) outputting and displaying golf club preference information based on the calculated user-specific expected COR.

2. The method of claim 1, wherein the impact location data in step (a) is generated using a launch monitor.

3. The method of claim 1, wherein the impact location data in step (a) is generated using a swing sensor secured to a portion of the test golf club.

4. The method of claim 1, wherein the step (b) comprises best-fitting the first data to a predetermined probability distribution function.

5. The method of claim 4, wherein the predetermined probability distribution function comprises a Gaussian distribution function.

6. The method of claim 1, wherein the golf club preference information comprises the user-specific expected COR values for at least one of the plurality of golf clubs.

7. The method of claim 1, wherein the golf club preference information comprises an identification of a preferred golf club of the plurality of golf clubs, the preferred golf club having the greatest expected COR value of the plurality of golf clubs.

8. The method of claim 1, wherein the golf club preference information comprises a listing of the plurality of golf clubs ordered by expected COR value.

9. A method of selecting a golf club head for a specific user, the method comprising the steps of:

(a) receiving first data comprising impact location of each of a plurality of golf swings taken by the user using a test golf club;

(b) generating an impact probability map specific to the user;

(c) providing second data comprising correlations between striking face location and characteristic time (CT) for each of a plurality of golf clubs;

(d) calculating a user-specific expected CT value for each of the plurality of golf clubs based on the first data, the impact probability map, and the second data for each of the plurality of golf clubs; and (e) outputting and displaying golf club preference information based on the calculated user-specific expected CT values.

10. The method of claim 9, wherein the impact location data in step (a) is generated using a launch monitor.

11. The method of claim 9, wherein the impact location data in step (a) is generated using a swing sensor secured to a portion of the test golf club.

12. The method of claim 9, wherein the step (b) comprises best-fitting the first data to a predetermined probability distribution function.

13. The method of claim 12, wherein the predetermined probability distribution function comprises a Gaussian distribution function.

14. The method of claim 9, wherein the golf club preference information comprises the user-specific expected CT values for at least one of the plurality of golf clubs.

15. The method of claim 9, wherein the golf club preference information comprises an identification of a preferred golf club of the plurality of golf clubs, the preferred golf club having the greatest expected CT value of the plurality of golf clubs.

16. The method of claim 9, wherein the golf club preference information comprises a listing of the plurality of golf clubs ordered by expected CT value.

* * * * *